US006685540B2

(12) United States Patent
Cherian et al.

(10) Patent No.: US 6,685,540 B2
(45) Date of Patent: Feb. 3, 2004

(54) POLISHING PAD COMPRISING PARTICLES WITH A SOLID CORE AND POLYMERIC SHELL

(75) Inventors: Isaac K. Cherian, Aurora, IL (US); Sriram P. Anjur, Aurora, IL (US); Steven K. Grumbine, Aurora, IL (US)

(73) Assignee: Cabot Microelectronics Corporation, Aurora, IL (US)

( * ) Notice: Subject to any disclaimer, the term of this patent is extended or adjusted under 35 U.S.C. 154(b) by 28 days.

(21) Appl. No.: 09/995,025

(22) Filed: Nov. 27, 2001

(65) Prior Publication Data

US 2003/0100244 A1 May 29, 2003

(51) Int. Cl.[7] ..... B24B 1/00; B24D 11/00
(52) U.S. Cl. ..... 451/41; 451/530
(58) Field of Search ..... 451/41, 527, 530, 451/526, 528, 534, 538; 51/298, 307, 308, 309

(56) References Cited

U.S. PATENT DOCUMENTS

| | | | | |
|---|---|---|---|---|
| 4,260,396 A | | 4/1981 | Glemza | |
| 4,954,140 A | | 9/1990 | Kawashima et al. | |
| 5,578,362 A | | 11/1996 | Reinhardt et al. | |
| 5,632,668 A | * | 5/1997 | Lindholm et al. | 451/42 |
| 5,785,784 A | | 7/1998 | Chesley et al. | |
| 5,876,266 A | | 3/1999 | Miller et al. | |
| 5,900,164 A | | 5/1999 | Budinger et al. | |
| 5,958,794 A | | 9/1999 | Bruxvoort et al. | |
| 5,975,988 A | * | 11/1999 | Christianson | 451/28 |
| 6,117,000 A | | 9/2000 | Anjur et al. | |
| 6,120,361 A | | 9/2000 | Konishi et al. | |
| 6,231,434 B1 | * | 5/2001 | Cook et al. | 451/527 |
| 6,390,890 B1 | * | 5/2002 | Molnar | 451/41 |
| 2002/0004365 A1 | | 1/2002 | Jeong et al. | |

FOREIGN PATENT DOCUMENTS

| | | |
|---|---|---|
| JP | 11-285961 | 10/1999 |
| JP | 2000-33552 | 2/2000 |

* cited by examiner

*Primary Examiner*—Dung Van Nguyen

(57) ABSTRACT

The invention provides a polishing pad comprising composite particles that comprise a solid core encapsulated by a polymeric shell material, wherein the solid core comprises a material that differs from the polymeric shell material, as well as a method of polishing a substrate with such a polishing pad.

42 Claims, 4 Drawing Sheets

POLISHING PAD COMPRISING PARTICLES WITH A SOLID CORE AND POLYMERIC SHELL

FIELD OF THE INVENTION

The invention pertains to a polishing pad that can be used for the polishing of a substrate, as well as a method of using the polishing pad to polish a substrate.

BACKGROUND OF THE INVENTION

A semiconductor wafer typically includes a substrate, such as a silicon or gallium arsenide wafer, on which a plurality of integrated circuits have been formed. Integrated circuits are chemically and physically integrated into a substrate by patterning regions in the substrate and layers on the substrate. The layers are generally formed of materials having either a conductive, insulating, or semiconducting nature. It is crucial that the surface onto which the layers are placed is as flat as possible. If a wafer is not flat and smooth, various problems can occur that may result in an inoperable device. Specifically, a smooth topography is desirable because it is difficult to lithographically image and pattern layers applied to rough surfaces. For example, in fabricating integrated circuits, it is necessary to form conductive lines or similar structures above a previously formed structure. However, prior surface formation often leaves the top surface topography of a wafer highly irregular and containing bumps, areas of unequal elevation, troughs, trenches, and other types of surface irregularities. The semiconductor industry continues to concentrate on achieving a surface of even topography by decreasing the number and size of surface imperfections through improved polishing techniques.

Although several surface polishing techniques exist to ensure wafer surface planarity, processes employing chemical-mechanical polishing (also referred to as planarization) techniques have achieved widespread usage during the various stages of integrated circuit fabrication to improve yield, performance, and reliability. A chemical-mechanical polishing (CMP) process typically involves the circular motion of a substrate to be polished (such as a wafer) under a controlled downward pressure relative to a polishing pad that is saturated with a polishing composition (also referred to as a polishing slurry) under controlled conditions.

The polishing composition generally contains small, abrasive particles that mechanically abrade the surface of the substrate to be polished in a mixture with chemicals that chemically react with (e.g., remove and/or oxidize) the surface of the substrate to be polished. Thus, when the polishing pad and the substrate to be polished move with respect to each other, material is removed from the surface of the substrate mechanically by the abrasive particles and chemically by other components in the polishing composition.

Typical polishing pads available for polishing applications, such as CMP processes, are manufactured using both soft and rigid pad materials, which include polymer-impregnated fabrics, microporous films, cellular polymer foams, non-porous polymer sheets, and sintered thermoplastic particles. A pad containing a polyurethane resin impregnated into a polyester non-woven fabric is illustrative of a polymer-impregnated fabric polishing pad. Such polymer-impregnated fabrics are commonly manufactured by impregnating a continuous roll of fabric with a polymer (i.e., generally polyurethane), curing the polymer, and cutting, slicing, and buffing the pad to the desired thickness and lateral dimensions. Microporous polishing pads include microporous urethane films coated onto a base material, which is often an impregnated pad. Such porous films commonly are composed of a series of vertically oriented closed end cylindrical pores. Cellular polymer foam polishing pads contain a closed cell structure that is randomly and uniformly distributed in all three dimensions. The porosity of closed cell polymer foams is typically discontinuous. Non-porous polymer sheet polishing pads include a polishing surface made from solid polymer sheets, which have no intrinsic ability to transport slurry particles (see, for example, U.S. Pat. No. 5,489,233). These solid polishing pads are externally modified with large and small grooves that are cut into the surface of the pad purportedly to provide channels for the passage of slurry during chemical-mechanical polishing. A similar non-porous polymer sheet polishing pad is disclosed in U.S. Pat. No. 6,203,407, wherein the polishing surface of the polishing pad comprises grooves that are oriented in such a way that purportedly improves selectivity in the chemical-mechanical polishing. Also in a similar fashion, U.S. Pat. Nos. 6,022,268, 6,217,434, and 6,287,185 disclose hydrophilic polishing pads with no intrinsic ability to absorb or transport slurry particles. The polishing surface purportedly has a random surface topography including microaspersities that are 10 $\mu$m or less and formed by solidifying the polishing surface and macrodefects (or macrotextures) that are 25 $\mu$m or greater and formed by cutting. Sintered polishing pads comprising a porous open-celled structure can be prepared from thermoplastic polymer resins. For example, U.S. Pat. Nos. 6,062,968 and 6,126,532 disclose polishing pads with open-celled, microporous substrates, produced by sintering thermoplastic resins with a pellet size of about 50 to about 200 mesh. The resulting polishing pads preferably have a void volume between 25 and 50% and a density of 0.7 to 0.9 g/cm$^3$. Similarly, U.S. Pat. Nos. 6,017,265, 6,106,754, and 6,231,434 disclose polishing pads with uniform, continuously interconnected pore structures, produced by sintering thermoplastic polymers at high pressures in excess of 689.5 kPa (100 psi) in a mold having the desired final pad dimensions.

Where enhanced polishing composition transport is desired on or through a polishing pad, the polishing pad typically is textured with channels, grooves, and/or perforations to improve lateral polishing composition transport during substrate polishing.

Polishing composition delivery and distribution to the polishing surface is important for a CMP process to provide effective substrate planarization. Inadequate or non-uniform polishing composition flow across the polishing pad may give rise to non-uniform polishing rates, poor surface quality across the substrate, or deterioration of the polishing pad. U.S. Pat. No. 5,489,233 discloses the use of large and small flow channels to permit transport of a polishing composition across the surface of a solid polishing pad. U.S. Pat. No. 5,533,923 discloses a polishing pad constructed to include conduits that pass through at least a portion of the polishing pad to permit flow of the polishing composition. Similarly, U.S. Pat. No. 5,554,064 describes a polishing pad containing spaced apart holes to distribute the polishing composition across the pad surface. Alternatively, U.S. Pat. No. 5,562,530 discloses a pulsed-forced system that allows for the down force holding a wafer onto a polishing pad to cycle periodically between minimum (i.e., polishing composition flows into space between the wafer and pad) and maximum (i.e., polishing composition squeezed out, thereby allowing for the abrasive nature of the polishing pad to erode the wafer surface) values.

While current polishing pads have been suitable, there remains a need for an improved polishing pad. The invention provides such a polishing pad and a method of preparing and using such a polishing pad. These and other advantages of the invention, as well as additional inventive features, will be apparent from the description of the invention provided herein.

BRIEF SUMMARY OF THE INVENTION

The inventive polishing pad comprises composite particles comprising a solid core encapsulated by a polymeric shell material, wherein the solid core comprises a material that differs from the polymeric shell material. The inventive method of polishing a substrate using such a polishing pad comprises providing a substrate and such a polishing pad, contacting the substrate with the polishing pad, and moving the polishing pad relative to the substrate to polish the substrate.

DETAILED DESCRIPTION OF THE INVENTION

The invention provides a polishing pad comprising composite particles. The composite particles comprise a solid core encapsulated by a polymeric shell material, wherein the solid core comprises a material that differs from the polymeric shell material. The invention also provides a method for polishing a substrate using such a polishing pad.

Figure 1:
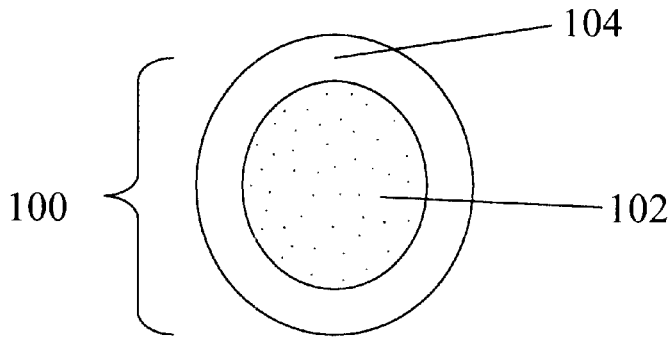
FIG. 1 is a cross-sectional view of a composite particle useful in the invention.

As shown in FIG. 1, the composite particles 100 are comprised of a solid core 102 and a polymeric shell 104. The solid core 102 comprises a material that differs from the material of the polymeric shell 104. The solid core 102 can be of any suitable material that is solid under the conditions of use. The solid core desirably is selected from the group consisting of ceramic materials, metals, metal oxides, and polymers. The metal oxide desirably is selected from the group consisting of alumina, silica, titania, ceria, zirconia, germania, magnesia, co-formed products thereof, and combinations thereof. The solid core also can be one or more inorganic matters selected from the group consisting of oxides, carbides, nitrides, diamond, mixtures thereof, and combinations thereof. The solid core can be, but need not be, a single entity. Thus, the solid core can be in two or more discrete parts. For example, the core can comprise solid particles, such as, an agglomeration of particles, e.g., metal oxide particles.

The polymeric shell 104 can be of any suitable polymeric material, such as an ionomer or a polyurethane or any other polymer or derivative thereof. The polymeric shell material desirably shows a high wear resistance similar to that of polyurethane, such as nylon 6/10, nylon 11, or polyethylene. In addition, the polymeric shell can contain any suitable substances in addition to one or more polymers. Such substances can be the same or different than the solid core material as described herein. In particular, a liquid suspension comprising solid abrasive components or merely solid abrasive components can be placed within the polymeric shell (i.e., within the matrix of the polymeric shell) of all or some, e.g., one or more layers, of the composite particles of the polishing pad. Such a liquid suspension can be a polar (e.g., water) or nonpolar (e.g., alcohols) suspension. The abrasive components desirably are one or more inorganic matters selected from the group consisting of oxides (especially metal oxides), carbides, nitrides, diamond, mixtures thereof, and combinations thereof. The abrasive components are released when the polymeric shell of the particle is at least partially removed, e.g., by breaking, deconstructing, degrading, or wearing of the composite particles. The presence of abrasive components within the polymeric shell can reduce the wear rate of the polymer shell (i.e., the speed at which the polymer shell is eroded). The number of layers of such composite particles, therefore, can determine the practical life of the polishing pad during use in polishing substrates.

The composite particles 100 (and the solid core 102 encapsulated by the polymeric shell 104) can be of any suitable shape and size. The composite particles 100 typically will be substantially spherical in shape and about 1 $\mu$m to about 2 mm in diameter (e.g., about 1 $\mu$m to about 1 mm in diameter). The solid core 102 typically will be substantially spherical in shape and about 0.5 $\mu$m to about 1 mm in diameter and preferably about 0.5 $\mu$m to about 0.5 mm in diameter). The polymeric shell 104 can be of any suitable thickness. Typically, the polymeric shell 104 will be relatively thin compared to the diameter of the solid core. The thickness of the polymeric shell preferably is about 5% to about 150% of the diameter of the solid core, more preferably about 5% to about 100% of the diameter of the solid core, and most preferably about 10% to about 50% of the diameter of the solid core.

Figure 2:
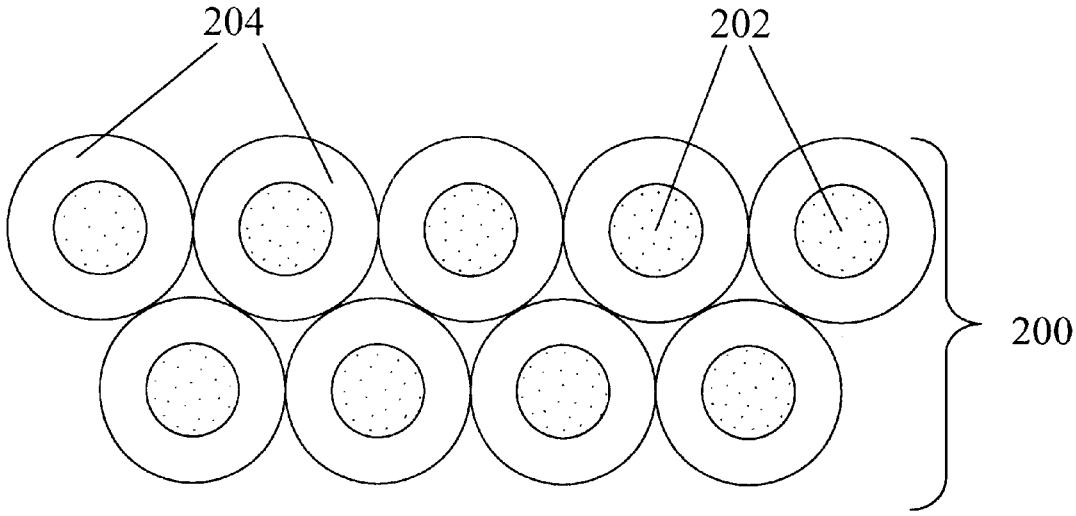
FIG. 2 is a partial cross-sectional view of a polishing pad of the invention.

The polishing pad can comprise any suitable amount of the composite particles. A cross sectional view of a polishing pad 200 of the invention is shown in FIG. 2. A portion of or all of the particles of the polishing pad can be composite particles comprising a solid core 202 encapsulated by a polymeric shell material 204, wherein the solid core comprises a material that differs from the polymeric shell material. The composite particles can exist in any suitable arrangement within the polishing pad. Preferably, the composite particles are arranged in at least one layer (e.g., two or more layers) in the polishing pad, especially on the polishing surface (i.e., the surface of the polishing pad that contacts the substrate to be polished with the polishing pad). The polishing pad 200 shown in FIG. 2 contains two layers of composite particles.

The polishing pad can comprise interstices between the composite particles. As shown in the partial cross-sectional views of FIGS. 3A and 3B, the polishing pad 300 can comprise interstices 306 and 308 between the composite particles 302. Such interstices can contain any suitable substance(s) 304, i.e., interstitial substance(s) 304. An interstitial substance desirably is an absorbent (e.g., hydrogel, polyacrylic acid (PAA), sodium polyacrylate, and their derivatives) or a metal oxide (e.g., silica). The interstitial substance (especially when a metal oxide such as silica) preferably is in the form of an aerogel, xerogel, or a combination thereof. The interstitial substance(s) can be the same or different than the solid core material and/or polymeric shell material as described herein.

An aerogel is a low-density porous transparent material that consists of more than 90% air. Aerogels are produced from certain gels, usually a metal oxide gel, by heating the gel under pressure to cause the liquid in the gel to become supercritical (in a state between a liquid and a gas) and lose its surface tension. In this state, the liquid may be removed from the gel by applying additional heat without disrupting the porous network formed by the gel's solid component. Aerogels are among the lightest existing solid materials and can have surface areas as high as 1,000 $m^2/g$. Aerogels can be both transparent and porous. A xerogel consists of silicon dioxide riddled with bubbles 20 nanometers in diameter or smaller. A xerogel looks like window glass but is somewhat cloudy because it is comprised of 70 to 80 percent bubbles. As the amount of air is reduced within an xerogel, the material becomes clearer, stable, and more rigid. Xerogels are similar to aerogels but are made in a different way (xerogels are dried in near-ambient conditions, as compared to aerogels, which are dried under supercritical conditions) and are used more easily in manufacturing. In addition to being thermally stable, xerogels offer the principal advantage of maintaining a low dielectric constant ($\kappa$).

Figure 3A:
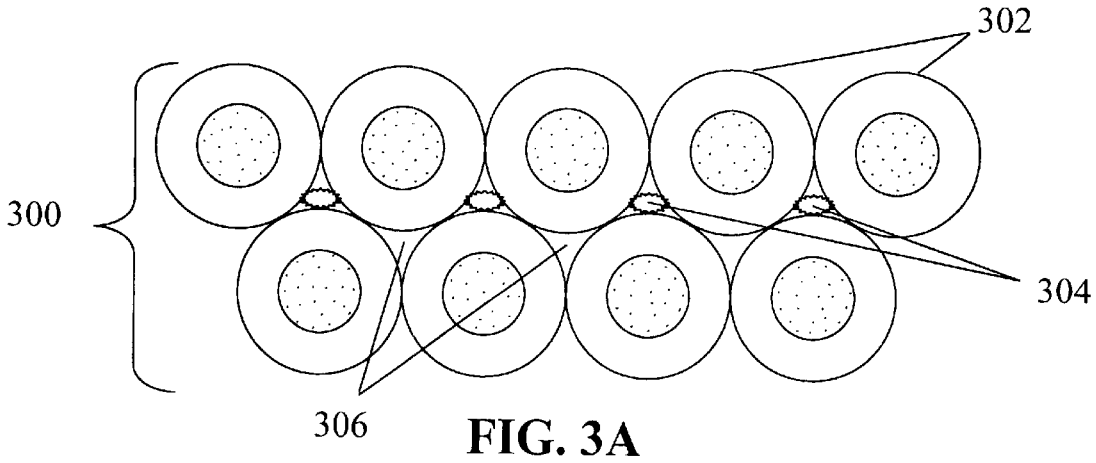
FIGS. 3A and 3B are partial cross-sectional views of polishing pads of the invention with an interstitial substance near the polishing surface (FIG. 3A) or at the polishing surface (FIG. 3B) of the polishing pad.
Figure 3B:
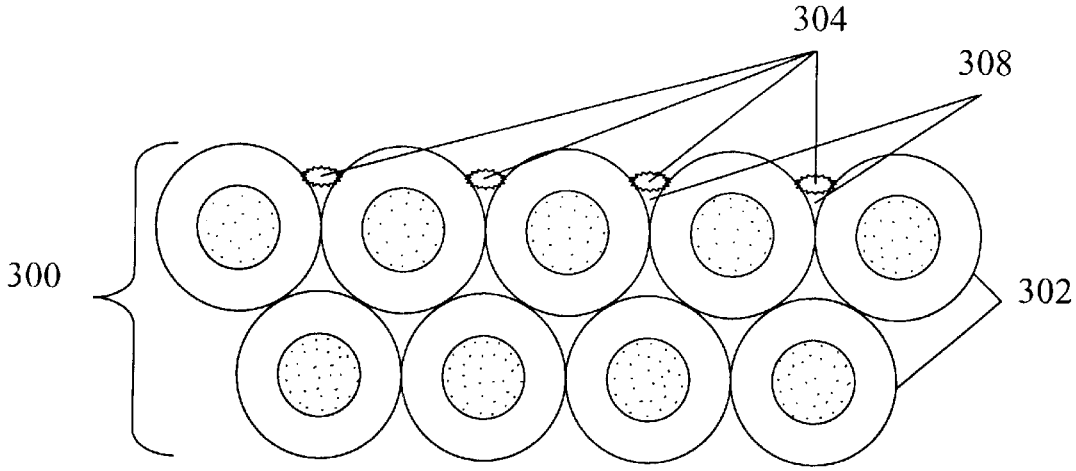

The interstitial substance(s) 304 can be located in some or all of the interstices 306 and 308 between the composite particles. Desirably, the interstitial substance(s) 304 is (are) located in interstices 306 near the polishing surface of the polishing pad 300 as shown in FIG. 3A and/or in interstices 308 on or at the polishing surface of the polishing pad 300 as shown in FIG. 3B. At least a portion of the interstitial substance(s) desirably is released (e.g., migrates) to the polishing surface when pressure is applied to the polishing surface of the polishing pad, particularly when the interstitial substance(s) are positioned below the polishing surface of the polishing pad, such as shown in FIG. 3A. When the interstitial substance(s) is (are) abrasive materials on or at the polishing surface of the polishing pad, such as shown in FIG. 3B, the polishing pad can be a fixed abrasive polishing pad. Any suitable interstitial substance can be used as an abrasive, with the interstitial substance desirably being one or more inorganic matters selected from the group consisting of oxides (especially metal oxides), nitrides, carbides, diamond, mixtures thereof, and combinations thereof.

Figure 4:
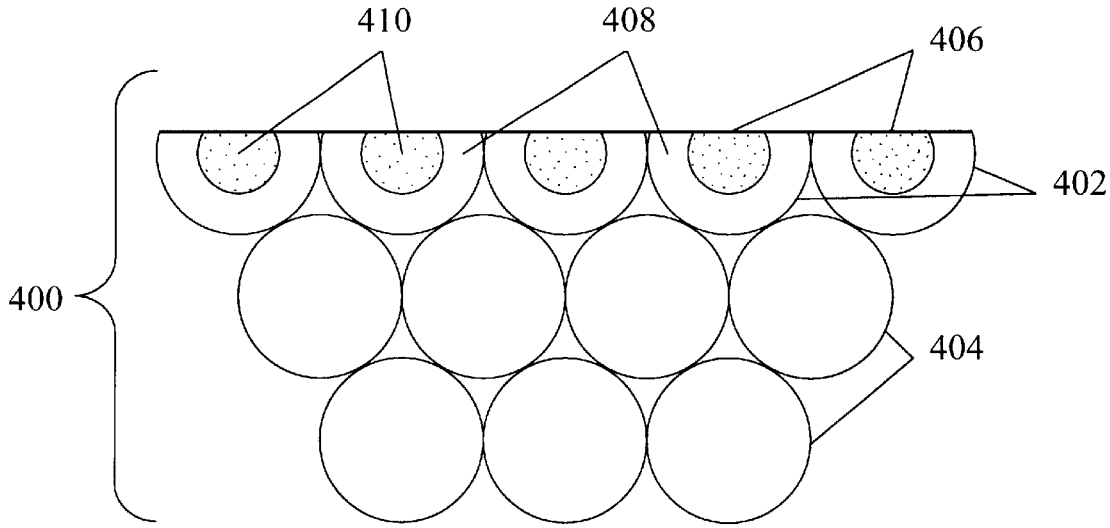
FIG. 4 is a partial cross-sectional view of a polishing pad of the invention and fixed abrasive materials.

As shown in FIG. 4, the polishing pad 400 can comprise particles 402 and other, e.g., conventional, particles 404. The composite particles 402 can form the polishing surface 406 overlaying conventional (e.g., polyurethane) particles 404. The composite particles 402 are shown in FIG. 4 as being partially eroded. The polymeric shell 408 of the composite particles 402 desirably is embedded into the conventional particles 404. The polymeric (e.g., polyurethane) shell 408 of the composite particles 402 at the polishing surface 406 can be eroded by a break-in process or a conditioning process to expose the solid core 410. When the solid core comprises or consists of abrasive particles, the exposed solid core is used as an abrasive during the polishing process. In that respect, the polishing pad can be a fixed abrasive polishing pad.

Figure 5:
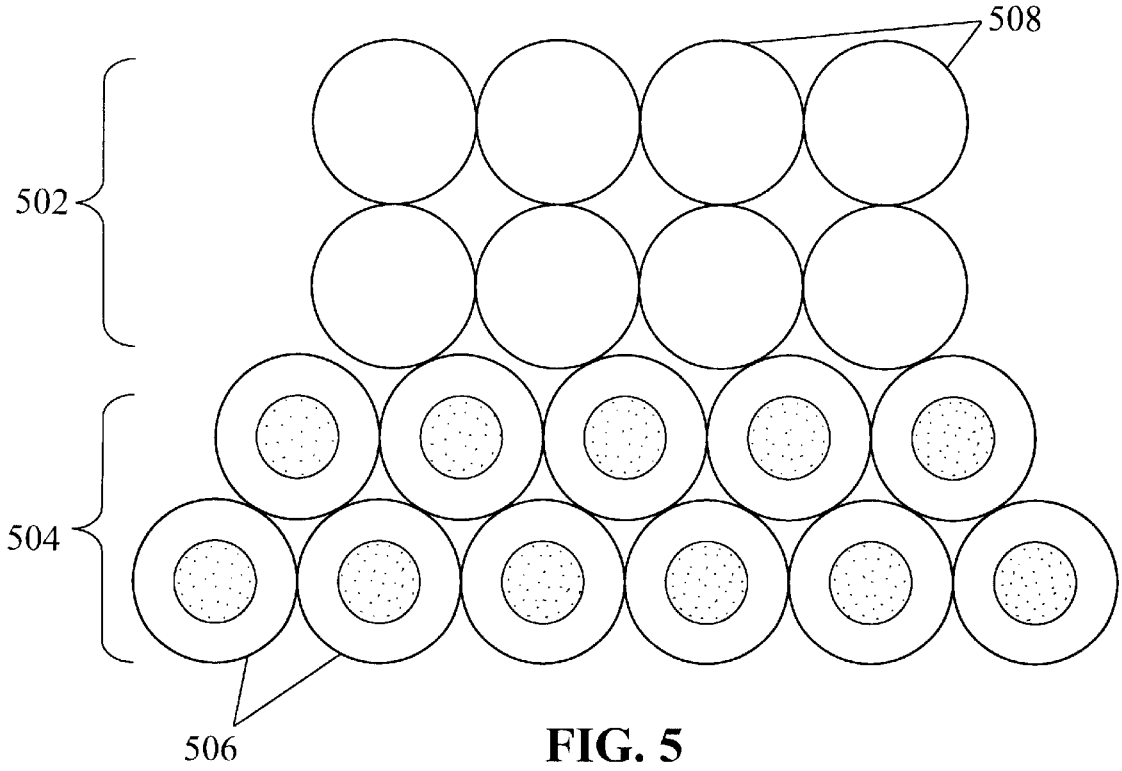
FIG. 5 is a partial cross-sectional view of a polishing pad of the invention with a sub-pad of composite particles.

The polishing pad need not comprise, but typically will comprise, a sub-pad. A partial cross-sectional view of a polishing pad with an upper pad portion 502 (containing the polishing surface) and a sub-pad 504 is shown in FIG. 5. The polishing pad upper portion 502 comprises conventional (e.g. polyurethane) particles 508, and the sub-pad 504 comprises composite particles 506. A sub-pad typically is used in a polishing pad to promote uniformity of contact between the polishing pad and the substrate to be polished with the polishing pad. The sub-pad 504 can comprise any suitable material, preferably a material that is nonabsorbent with respect to the polishing composition to be used with the polishing pad. The sub-pad 504 can have any suitable thickness and can be coextensive with any portion, preferably all, of a surface of the polishing pad. The sub-pad desirably is located opposite the surface of the polishing pad intended to be in contact with the substrate to be polished with the polishing pad (i.e., opposite the polishing surface) and desirably forms the surface of the polishing pad intended to be in contact with the platen or other structure of the polishing device that supports the polishing pad in the polishing device.

The polishing pad can comprise both composite particles as described herein and other material, e.g., conventional particles. Such a polishing pad can have any suitable preparations and distributions of the composite particles and other material. For example, the composite particles may be distributed in a regular pattern at or on the polishing surface of the polishing pad, as shown in FIG. 6, or the composite particles may be randomly distributed throughout a portion or all of the polishing pad, as shown in FIG. 7.

Figure 6:
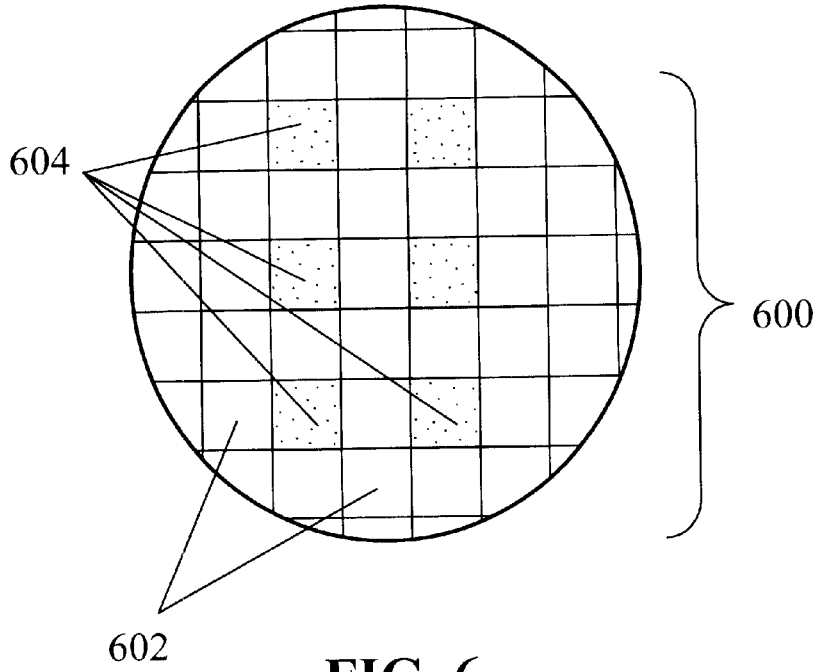
FIG. 6 is a top view of a polishing pad of the invention with tailored domains of composite particles.

FIG. 6 represents a top view of a circular pad 600. The polishing pad 600 comprises conventional material that forms conventional regions 602 and composite particles that form a plurality of composite domains 604. The composite domains 604 can possess, for example, a different mechanical property than the conventional regions as a result of the different nature of the particles that form those regions. While the composite domains 604 have been shown in FIG. 6 to be generally rectangular, the composite domains can be any desired shape.

Figure 7:
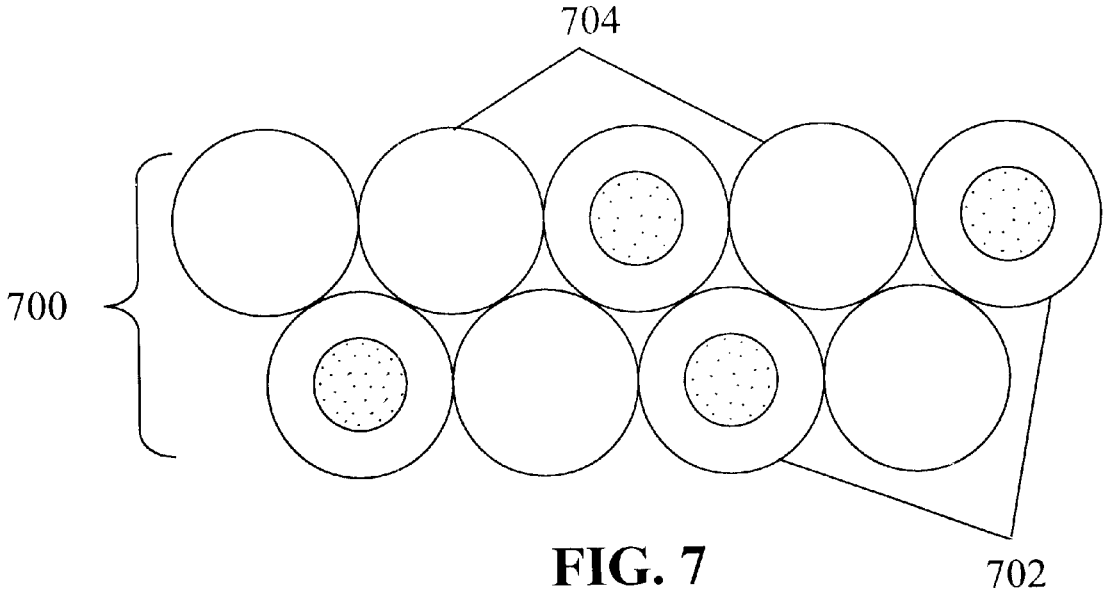
FIG. 7 is a partial cross-sectional view of a polishing pad of the invention with randomized composite particles.

FIG. 7 is a partial cross-sectional view of an abrasive pad 700. The abrasive pad 700 has a plurality of composite particles 702 and a plurality of conventional, e.g., polyurethane, particles 704. The particles 702 and 704 are randomly situated within the polishing pad 700. In order to achieve such a polishing pad, a plurality of composite particles 702 can be blended with a plurality of conventional particles 704 and then formed, e.g., sintered, into the polishing pad.

The polishing pad can be prepared in any suitable manner, such as by utilizing polymeric coating techniques (to form the composite particles) and sintering techniques (to form the polishing pad from the composite particles) known to those skilled in the art. Suitable sintering techniques can involve a continuous belt or closed mold process. A closed mold sintering technique is described in U.S. Pat. No. 4,708,839.

Preferably, the composite particles comprising a solid core encapsulated by a polymeric shell material, e.g., polyurethane, are provided with the desired dimensions, e.g., solid core diameter, polymeric shell thickness, and overall particle size and shape. The composite particles then desirably are dried (if necessary) to reduce the water content thereof (particularly of the polymeric shell material) to a suitable level, e.g., about 1 wt. % or less, preferably about 0.05 wt. % or less. Also, the composite particles can be treated (e.g., polished) to remove any sharp edges, so as to thereby reduce the pore volume and increase the density of the resulting polishing pad as appropriate.

The composite particles then are subjected to a sintering process. In a closed mold sintering process, for example, the composite particles are placed in a pre-shaped two-piece mold cavity to the desired level. The composite particles may be optionally mixed or blended with a powdered surfactant before incorporation into the mold to improve the free-flow characteristics of the composite particles. The mold is closed and vibrated (e.g., for about 15 seconds to about 2 minutes) to evenly spread the composite particles throughout the mold cavity.

The mold cavity then is heated to sinter the composite particles together. The heat cycle for sintering the composite particles involves evenly heating the mold to a predetermined temperature over a pre-determined time period, maintaining the mold at a set temperature for an additional pre-determined time period, and then cooling the mold to room temperature over another pre-determined time period. Those of ordinary skill in the art will appreciate that the thermal cycles can be varied to accommodate changes in the materials and molds. In addition, the mold can be heated in a variety of ways, including the use of microwaves, electrically or steam-heated hot air ovens, heated and cooled platens, and the like.

The actual temperature to which the mold is heated will depend upon the particular polymeric shell material. For example, for TEXIN® 970 u resin, commercially available from Bayer Corporation, the mold is heated to and maintained at a temperature of from about 180° C. to about 210° C., and preferably from about 185° C. to about 205° C. It is preferred that the composite particles are sintered at ambient pressures (i.e., no gaseous or mechanical methods are used to increase the pressure within the mold cavity to increase the density of the resulting polishing pad).

The mold desirably is heated in a horizontal position to allow a skin layer to form on the polishing pad substrate bottom surface during sintering. The mold preferably is not heated immediately to the desired temperature but rather is allowed to reach the desired temperature over a relatively short time period, e.g., from about 3 to 10 minutes or more, and preferably within about 4 to about 8 minutes from the beginning of the heating process. The mold then is maintained at the desired target temperature for a suitable time period, e.g., from about 5 minutes to about 30 minutes or more, and preferably from about 10 to about 20 minutes.

Upon completion of the heating step, the temperature of the mold is reduced, preferably steadily to a temperature of from about 20° C. to about 50° C. over a suitable period of time, e.g., from about 2 minutes to about 10 minutes or more. The mold then is allowed to cool to room temperature, whereupon the resulting sintered polishing pad substrate is removed from the mold. The aforementioned heating and cooling thermal cycle can be altered as appropriate to obtain the desired physical properties (e.g., pore size, voids volume, etc.) for the resulting sintered polishing pad.

The composite particles can also be sintered in a continuous process. During such process, the particles are placed on a conveyor belt and heated to the desired temperatures from locations above and below the conveyor belt. This heating is continued until the particles are properly sintered and a continuous sheet is formed.

The polishing pad can be in the form of many different embodiments. One embodiment consists of a polishing pad in which conventional (e.g., polyurethane) particles are utilized at the polishing surface and the composite particles are utilized in a sub-pad. Another embodiment is a polishing pad in which the composite particles are utilized in the polishing pad without a sub-pad. Yet another embodiment is a polishing pad in which a siliceous material (e.g., silica) in the form of an aerogel, a xerogel, or a combination thereof is in the interstices between the composite particles of the polishing pad. As mentioned above, this interstitial substance allows the polishing pad to display sponge-like qualities and release chemistry (i.e., the interstitial substance) when a force is exerted on the polishing pad.

The method of using the polishing pad to polish a substrate comprises (a) providing a substrate and a polishing pad of the invention and (b) moving the polishing pad relative to the substrate to polish the substrate. A polishing composition typically will be present between the polishing pad and the substrate during the movement of the polishing pad relative to the substrate. Desirably, the polishing pad is continually rotating, orbiting or revolving (i.e., as a belt) during the polishing process to allow for the removal of the polishing composition from the surface of polishing pad.

The method of polishing a substrate can be used to polish or planarize any suitable substrate, for example, a substrate comprising a glass, metal, metal oxide, metal composite, polymer possessing a low-κ, semiconductor base material, or combinations thereof. The substrate can comprise, consist essentially of, or consist of any suitable metal. Suitable metals include, for example, copper, aluminum, tantalum, titanium, tungsten, gold, platinum, iridium, ruthenium, and combinations (e.g., alloys or mixtures) thereof. The substrate also can comprise, consist essentially of, or consist of any suitable metal oxide. Suitable metal oxides include, for example, alumina, silica, titania, ceria, zirconia, germania, magnesia, co-formed products thereof, and combinations thereof. In addition, the substrate can comprise, consist essentially of, or consist of any suitable metal composite. Suitable metal composites include, for example, metal nitrides (e.g., tantalum nitride, titanium nitride, and tungsten nitride), metal carbides (e.g., silicon carbide and tungsten carbide), nickel-phosphorus, alumino-borosilicate, borosilicate glass, phosphosilicate glass (PSG), borophosphosilicate glass (BPSG), silicon/germanium alloys, and silicon/germanium/carbon alloys. The substrate also can comprise, consist essentially of, or consist of any suitable semiconductor base material. Suitable semiconductor base materials include single-crystal silicon, poly-crystalline silicon, amorphous silicon, silicon-on-insulator, and gallium arsenide.

The method of polishing a substrate is useful in the planarizing or polishing of many different types of workpieces, such as semiconductor wafers, memory or rigid disks, metals (e.g., noble metals), inter-layer dielectric (ILD) layers, shallow trench isolation (STI), micro-electro-mechanical systems, ferroelectrics, magnetic heads, polymeric films, and low and high dielectric constant films. The term "memory or rigid disk" refers to any magnetic disk, hard disk, rigid disk, or memory disk for retaining information in electromagnetic form. Memory or rigid disks typically have a surface that comprises nickel-phosphorus, but the surface can comprise any other suitable material.

The method of polishing a substrate is especially useful in polishing or planarizing a semiconductor device, for example, semiconductor devices having device feature geometries of about 0.25 μm or smaller (e.g., 0.18 μm or smaller). The term "device feature" as used herein refers to a single-function component, such as a transistor, resistor, capacitor, integrated circuit, or the like. The present method can be used to polish or planarize the surface of a semiconductor device, for example, in the formation of isolation structures by STI polishing methods, during the fabrication of a semiconductor device. The method also can be used to polish the dielectric or metal layers (i.e., metal interconnects) of a semiconductor device in the formation of an ILD.

All references, including publications, patent applications, and patents cited herein, are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A polishing pad comprising a plurality of composite particles having a solid core encapsulated by a polymeric shell material, wherein the solid core comprises a material that differs from the polymeric shell material, and wherein the polishing pad further comprises interstices between the composite particles.

2. The polishing pad of claim 1, wherein the polishing pad has a polishing surface, and the composite particles are arranged in at least one layer on the polishing surface.

3. The polishing pad of claim 2, wherein the polishing pad further comprises a substance different from the composite particles in the interstices between the composite particles.

4. The polishing pad of claim 3, wherein the interstitial substance is an aerogel, xerogel, a metal oxide, a hydrogel, an absorbent, or combination thereof.

5. The polishing pad of claim 4, wherein at least a portion of the interstitial substance is released to the polishing surface when pressure is applied to the polishing surface.

6. The polishing pad of claim 1, wherein the solid core material is a ceramic material.

7. The polishing pad of claim 1, wherein the solid core material is a metal.

8. The polishing pad of claim 1, wherein the solid core material is a polymer.

9. The polishing pad of claim 1, wherein the solid core material is an agglomeration of solid particles.

10. The polishing pad of claim 9, wherein the solid particles comprise one or more inorganic matters selected from the group consisting of oxides, carbides, nitrides, diamond, mixtures thereof, and combinations thereof.

11. The polishing pad of claim 1, wherein the polymeric shell material is selected from the group consisting of polyurethane, nylon 6/10, nylon 11, and polyethylene.

12. The polishing pad of claim 1, wherein the polishing pad comprises sintered composite particles.

13. The polishing pad of claim 1, wherein the polishing pad further comprises a plurality of polyurethane particles.

14. The polishing pad of claim 13, wherein the composite particles and the polyurethane particles are randomly situated within the polishing pad.

15. The polishing pad of claim 14, wherein the polishing pad has a polishing surface and the randomly situated particles are arranged in at least one layer on the polishing surface.

16. The polishing pad of claim 14, wherein the solid core material is a ceramic material.

17. The polishing pad of claim 14, wherein the solid core material is a metal.

18. The polishing pad of claim 14, wherein the solid core material is a polymer.

19. The polishing pad of claim 14, wherein the solid core material is an agglomeration of solid particles.

20. The polishing pad of claim 19, wherein the solid particles comprises one or more inorganic matters selected from the group consisting of oxides, carbides, nitrides, diamond, mixtures thereof, and combinations thereof.

21. The polishing pad of claim 14, wherein the polymeric shell material is selected from the group consisting of polyurethane, nylon 6/10, nylon 11, and polyethylene.

22. A method of polishing a substrate comprising (a) providing a substrate and a polishing pad of claim 14, (b) contacting the substrate with the polishing pad, and (c) moving the polishing pad relative to the substrate to polish the substrate.

23. The polishing pad of claim 13, wherein the polishing pad has a polishing surface, and the composite particles are arranged in at least one layer on the polishing surface overlaying at least one layer of polyurethane particles.

24. A method of polishing a substrate comprising (a) providing a substrate and a polishing pad of claim 1, (b) contacting the substrate with the polishing pad, and (c) moving the polishing pad relative to the substrate to polish the substrate.

25. The method of claim 24, wherein the polishing pad has a polishing surface, and the composite particles are arranged in at least one layer on the polishing surface.

26. The method of claim 25, wherein the polishing pad further comprises a substance different from the composite particles in the interstices between the composite particles.

27. The method of claim 26, wherein the interstitial substance is an aerogel, xerogel, a metal oxide, a hydrogel, an absorbent, or combination thereof.

28. The method of claim 27, wherein at least a portion of the interstitial substance is released to the polishing surface when pressure is applied to the polishing surface.

29. The method of claim 24, wherein the solid core material is a ceramic material.

30. The method of claim 24, wherein the solid core material is a metal.

31. The method of claim 24, wherein the solid core material is a polymer.

32. The method of claim 24, wherein the solid core material is an agglomeration of solid particles.

33. The method of claim 24, wherein the solid particles comprise one or more inorganic matters selected from the group consisting of oxides, carbides, nitrides, diamond, mixtures thereof, and combinations thereof.

34. The method of claim 24, wherein the polymeric shell material is selected from the group consisting of polyurethane, nylon 6/10, nylon 11, and polyethylene.

35. The method of claim 24, wherein all of the particles of the polishing pad comprise a solid core encapsulated by a polymeric shell material, wherein the solid core comprises a material that differs from the polymeric shell material.

36. The method of claim 24, wherein the polishing pad comprises one or more layers of the composite particles, wherein the composite particles comprise a solid core encapsulated by a polymeric shell, solid abrasive components are contained within the polymeric shell material, and the moving of the polishing pad relative to the substrate removes at least a portion of the polymeric shell, thereby releasing the solid abrasive components between the polishing pad and the substrate to assist in the polishing of the substrate.

37. The method of claim 36, wherein the abrasive components are selected from the group consisting of metal oxides, carbides, nitrides, diamond, and combinations thereof.

38. The method of claim 36, wherein the polymeric shell is selected from the group consisting of polyurethane, nylon 6/10, nylon 11, and polyethylene.

39. The method of claim 36, wherein the abrasive components are within the matrix of the polymeric shell.

40. A polishing pad having a polishing surface, wherein the polishing pad is comprised of composite particles having interstices therebetween, the composite particle comprises a solid core encapsulated by a polymeric shell material, the solid core comprises a material that differs from the polymeric shell material, the interstices therebetween contain a substance that is an aerogel, a xerogel, a metal oxide, a hydrogel, an absorbent, or combination thereof, and the composite particles are arranged in at least one layer on the polishing surface.

41. A polishing pad having a polishing surface, wherein the polishing pad is comprised of a mixture of composite particles and polyurethane particles, the composite particle comprises a solid core encapsulated by a polymeric shell material, the solid core comprises a material that differs from the polymeric shell material, and the composite particles are arranged on the polishing surface in at least one layer overlaying at least one layer of polyurethane particles.

42. A polishing pad having a polishing surface, wherein the polishing pad is comprised of a mixture of composite particles and polyurethane particles, the composite particle comprises a solid core encapsulated by a polymeric shell material, the solid core comprising a material that differs from the polymeric shell material, and the composite particles and polyurethane particles are randomly situated within the polishing pad.

* * * * *